US005760676A

United States Patent [19]

Yamada

[11] Patent Number: 5,760,676

[45] Date of Patent: Jun. 2, 1998

[54] ELECTRONIC PART SUCH AS PTC THERMISTOR AND CASING FOR THE SAME WITH A FUSE

[75] Inventor: Yoshihiro Yamada, Shiga-ken, Japan

[73] Assignee: Murata Manufacturing Co., Ltd., Japan

[21] Appl. No.: 820,439

[22] Filed: Mar. 12, 1997

Related U.S. Application Data

[63] Continuation of Ser. No. 466,578, Jun. 6, 1995, abandoned.

[30] Foreign Application Priority Data

Jun. 10, 1994 [JP] Japan ..... 6-128889

[51] Int. Cl.[6] ..... H01C 7/10

[52] U.S. Cl. ..... 338/22 R; 338/324; 338/225 D; 338/234; 337/183; 337/184

[58] Field of Search ..... 338/22 R, 220–222, 338/322–324, 225 D, 234; 361/104, 106; 337/171, 178, 317, 330, 183, 184, 142

[56] References Cited

U.S. PATENT DOCUMENTS

| | | | |
|---|---|---|---|
| 3,914,727 | 10/1975 | Fabricius | 338/22 R |
| 3,996,447 | 12/1976 | Bouffard et al. | 338/22 |
| 4,031,497 | 6/1977 | Ozawa | 338/308 |
| 4,635,026 | 1/1987 | Takeuchi | 338/22 R |
| 4,894,637 | 1/1990 | Yamada et al. | 338/22 R |
| 5,142,265 | 8/1992 | Motoyoshi et al. | 338/22 |
| 5,153,555 | 10/1992 | Enomoto et al. | 338/22 R |
| 5,382,938 | 1/1995 | Hansson et al. | 338/22 R |

FOREIGN PATENT DOCUMENTS

| | | | |
|---|---|---|---|
| 2531291 | 1/1977 | Germany . | |
| 5-82303 | 4/1993 | Japan | 338/22 R |
| 5-20571 | 1/1994 | Japan | 338/22 R |
| 6-1511107A | 5/1994 | Japan | 338/22 R |

OTHER PUBLICATIONS

German Office Action dated Dec. 12, 1996 and English translation.

*Primary Examiner*—Teresa J. Walberg
*Assistant Examiner*—Karl Easthom
*Attorney, Agent, or Firm*—Ostrolenk, Faber, Gerb & Soffen, LLP

[57] ABSTRACT

In a positive temperature coefficient thermistor, a terminal holding member is provided between an outer casing and an elastic terminal electrically connected to the semiconductor ceramic element. The terminal holding member is formed of a thermoplastic resin having a low softening point. Consequently, when an abnormally large amount of heat is generated in the semiconductor ceramic element, the terminal holding member melts and deforms, causing the semiconductor ceramic element to be separated and thereby electrically disconnected from the terminal.

7 Claims, 7 Drawing Sheets

ELECTRONIC PART SUCH AS PTC THERMISTOR AND CASING FOR THE SAME WITH A FUSE

This is a continuation of application Ser. No. 08/466,578 filed on Jun. 6, 1995, now abandoned.

BACKGROUND OF THE INVENTION

1. Field of the Invention

The present invention relates to an electronic part for heating, current limiting, temperature sensing, and so on, such as a thermistor having a positive temperature coefficient of resistance.

2. Description of the Related Art

The structure of a conventional electronic part, e.g., a positive temperature coefficient type thermistor, will be described with reference to FIG. 7. In FIG. 7, reference numeral 1 denotes a positive temperature coefficient thermistor including a semiconductor ceramic element 2 with electrodes 3 formed on two main surfaces thereof, terminals 4 and a casing 5. The terminals 4 are formed of a material showing electric conductivity. Each of the terminals 4 has a first end portion 4*a*, an elastic terminal spring portion 4*b* which presses against the semiconductor ceramic element 2 in such a manner that it holds the element 2, and a second end portion 4*c* which protrudes from a bottom surface of the casing 5 so that it can be connected to other parts. The casing 5 is made of a highly heat-resistant resin, such as a glass-reinforced engineering plastic or a thermosetting resin. The casing 5 has a casing body 5*a* and a casing lid 5*b*. The casing body 5*a* accommodates the semiconductor ceramic element 2 and the terminals 4. The second end portion 4*c* of the terminal 4 is extended to the outside of the casing through a hole 7 formed in the bottom surface of the casing body 5*a*.

Since positive temperature coefficient thermistors are generally characterized in that a large current flow at the initial stage of an operation occurs before the flow of small and constant current, they are employed in, for example, the demagnetizing circuit of a cathode ray tube or an electric device in which large current flow is required only immediately after the circuit or the device has been switched on.

However, such positive temperature coefficient thermistors have the following problems: when thermal runaway occurs due to application of an abnormal load to the thermistor or deterioration in the characteristics thereof caused by external factors, since the casing is made of a highly heat-resistant material and thus does not readily deform or break, a large current continues to flow in the thermistor and hence a small and constant current flow cannot be obtained. This state is close to a short-circuited state, i.e., the amount of heat generated in the positive temperature coefficient thermistor increases, and large current flows in other circuit elements as well.

The above-described thermal runaway can occur not only in positive temperature coefficient thermistors but also in other electronic parts for heating, current limiting, temperature sensing, and so on.

SUMMARY OF THE INVENTION

The present invention provides an electronic part which comprises a PTC (positive temperature coefficient) thermistor element, terminals held by members made of a material having a low softening point so that the terminals press against the element, and a casing.

In the electronic part for heating according to the present invention, when thermal runaway of the element occurs, the members made of a material having a low softening point melt and deform, causing the terminals to be separated and thereby electrically disconnected from the element.

Other objects, features and advantages of the invention will be seen in the following description of embodiments thereof, with reference to the drawings.

DETAILED DESCRIPTION OF THE PREFERRED EMBODIMENTS

Embodiments of a positive temperature coefficient thermistor according to the present invention will be described below with reference to the accompanying drawings.

(First embodiment)

Figure 7:
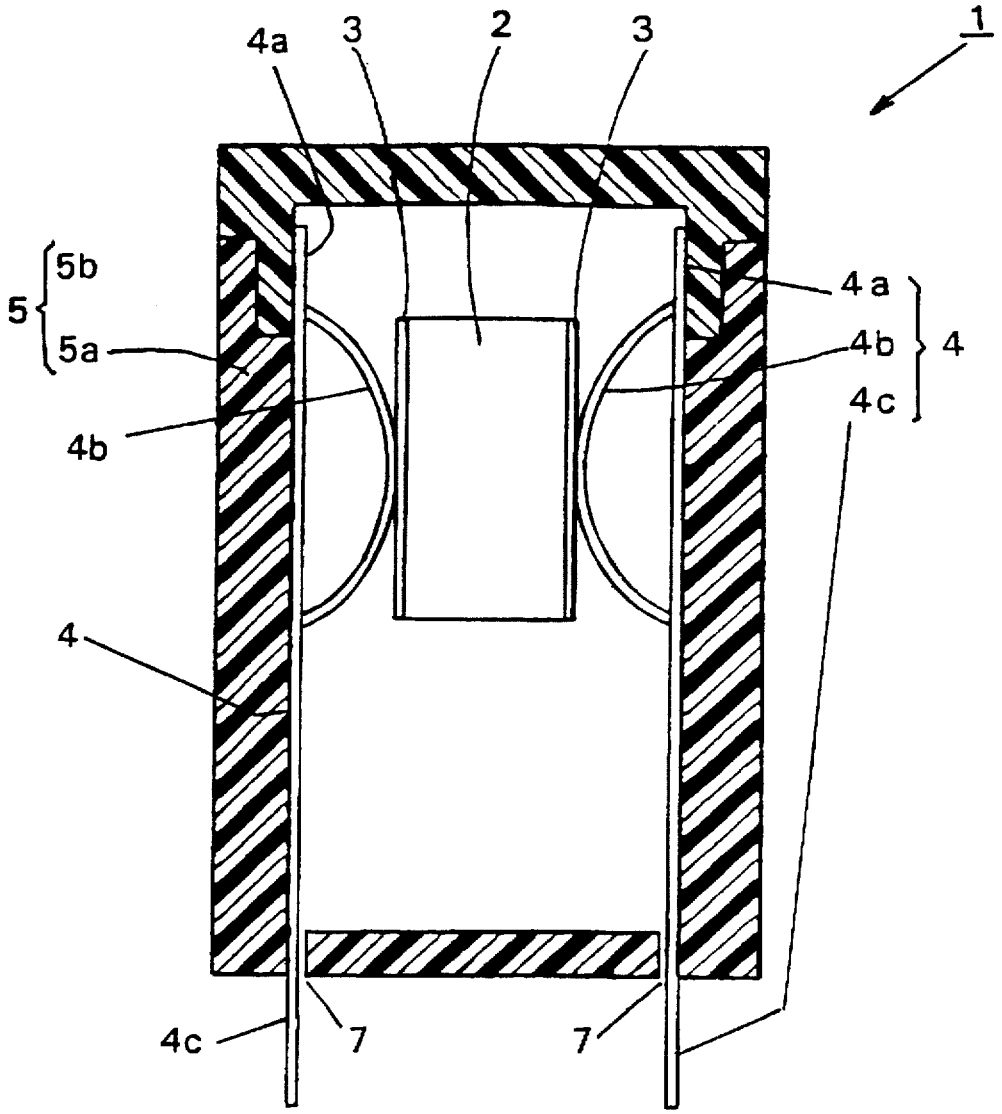
FIG. 7 PRIOR ART
FIG. 7 is a vertical cross-sectional view of a conventional positive temperature coefficient thermistor.

A positive temperature coefficient thermistor 10 according to a first embodiment of the present invention will be described with reference to FIG. 1. Reference numerals in FIG. 1 identical to those in FIG. 7 represent similar or identical elements.

Figure 1:
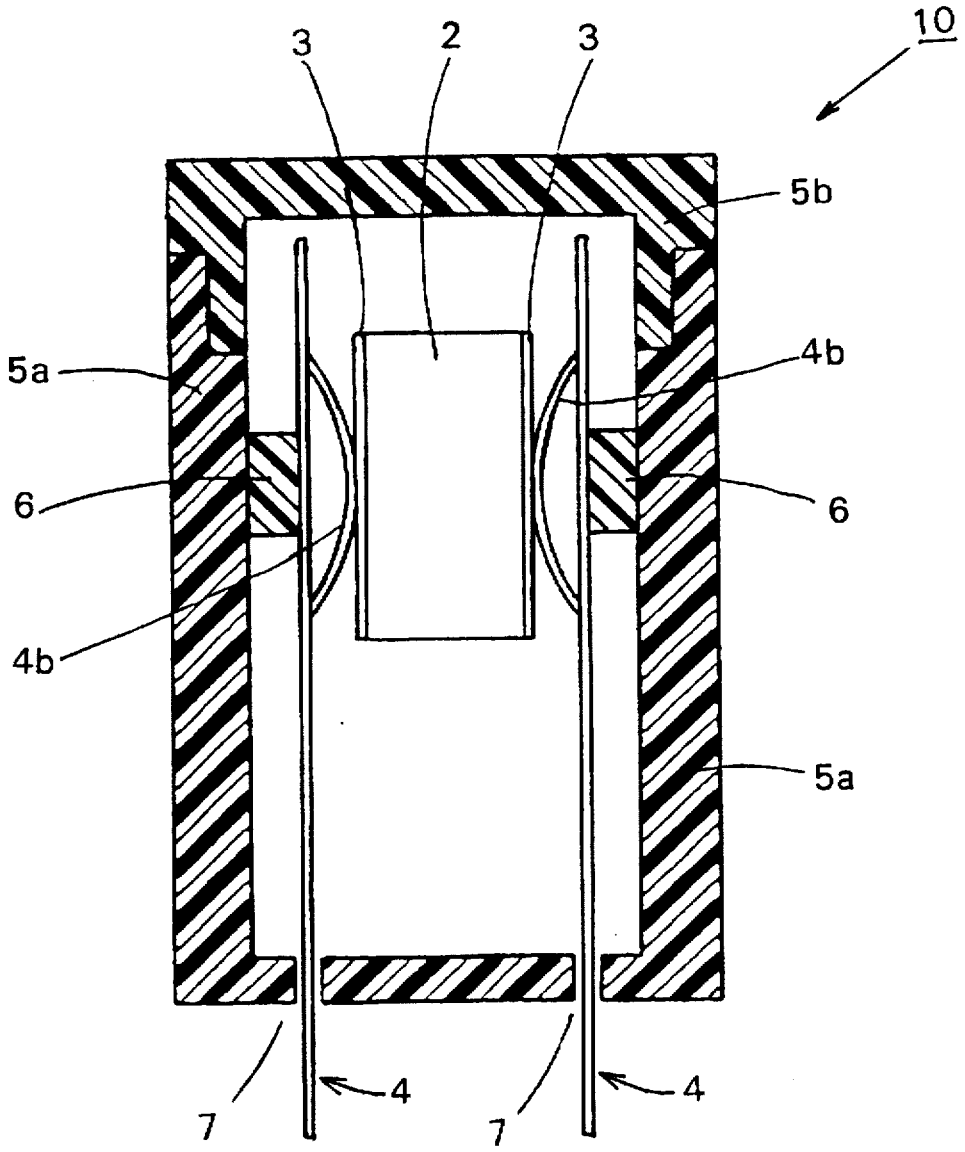
FIG. 1 is a vertical cross-sectional view of a first embodiment of a positive temperature coefficient thermistor according to the present invention.

In the positive temperature coefficient thermistor 10 shown in FIG. 1, the semiconductor ceramic element 2 with electrodes 3 formed on two main surfaces thereof is sandwiched between and thereby fixed by the spring portions 4*b* of the terminals 4. Each of the terminals 4 is held by a terminal holding member 6 located between the terminal 4 and the casing body 5*a*. The terminal holding members 6 are formed of a thermoplastic resin having a low softening point.

When a large current flows in the positive temperature coefficient thermistor 10, a larger quantity of heat than that in a steady state may be generated, resulting in thermal runaway. In that state, a large amount of heat continues to be supplied, increasing the temperature of each of the terminal holding members 6 to a value equal to or higher than the softening point of the thermoplastic resin which forms the terminal holding member 6. Accordingly, the terminal holding member 6 melts and deforms, causing the terminal 4 to fall away from the ceramic element 2 in an outward direction due to its elasticity. Consequently, the terminal 4 can no longer hold the semiconductor ceramic element 2, and current flow is cut off. Thus, the circuit is electrically opened and damage to the parts due to overheating can be prevented.

(Second embodiment)

A positive temperature coefficient thermistor 20 according to a second embodiment of the present invention will be described with reference to FIG. 2. Reference numerals in FIG. 2 identical to those in FIG. 7 represent similar or identical elements.

Figure 2:
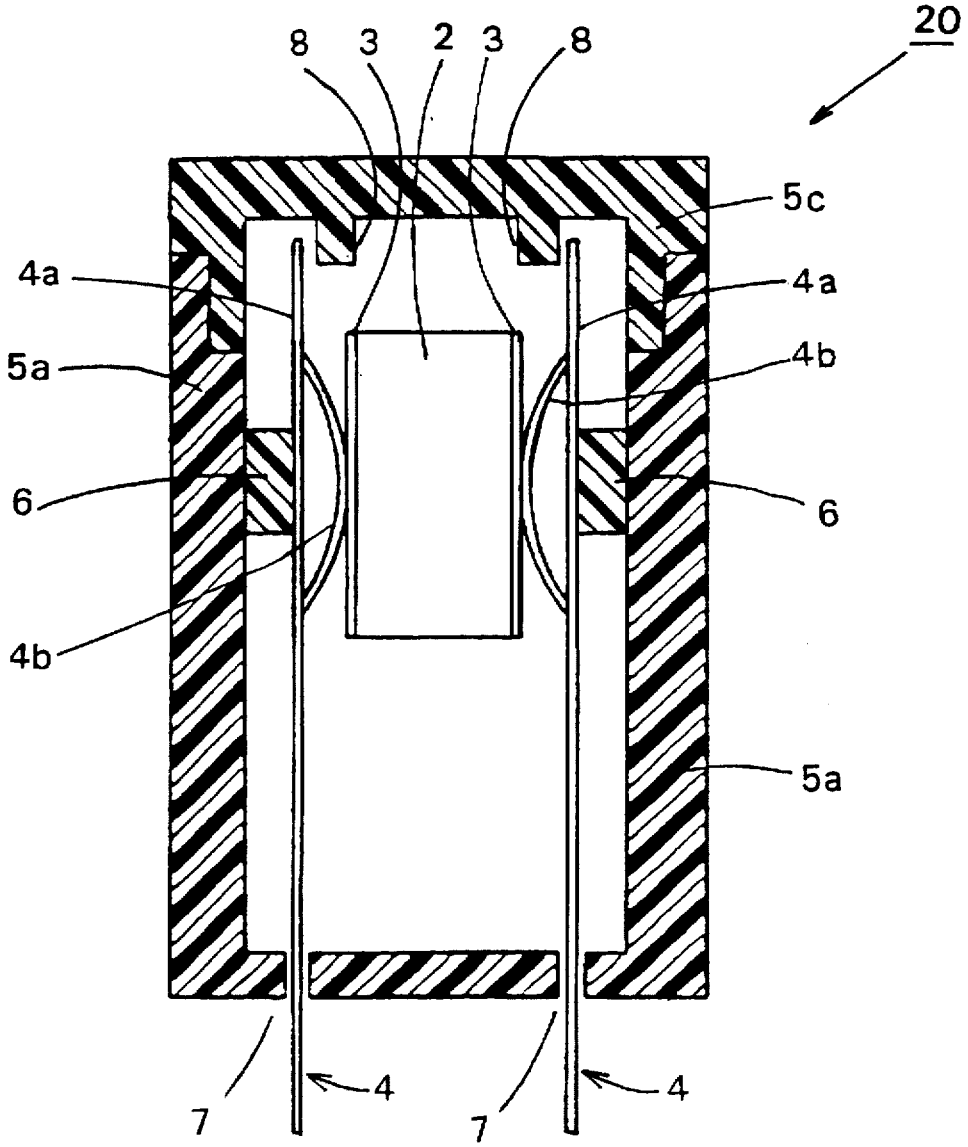
FIG. 2 is a vertical cross-sectional view of a second embodiment of the positive temperature coefficient thermistor according to the present invention.

In the positive temperature coefficient thermistor 20 shown in FIG. 2, the semiconductor ceramic element 2 with electrodes 3 formed on two main surfaces thereof is sandwiched between and thereby fixed by the spring portions 4b of the terminals 4. Each of the terminals 4 is held by a terminal holding member 6 located between the terminal 4 and the casing body 5a. The terminal holding members 6 are formed of a thermoplastic resin having a low softening point. A casing lid 5c has protrusions 8.

When a large current flows in the positive temperature coefficient thermistor 20, a larger quantity of heat than that in a steady state may be generated. In that state, the temperature of each of the terminal holding members 6 increases to a value equal to or higher than the softening point of the thermoplastic resin which forms the terminal holding member 6 due to the generated heat. Accordingly, the terminal holding member 6 melts and deforms, causing the terminal 4 to fall in an outward direction due to its elasticity and thereby separate from the semiconductor ceramic element 2. At that time, if the terminal 4 falls in an inward direction, the one end portion 4a comes into contact with the protrusion 8 provided on the casing lid 5c, preventing electrical connection of the terminal 4 to the semiconductor ceramic element 2. Consequently, the circuit is electrically opened, and damage to the parts due to overheating can thus be prevented.

(Third embodiment)

A positive temperature coefficient thermistor 30 according to a third embodiment of the present invention will be described with reference to FIG. 3. Reference numerals in FIG. 3 identical to those in FIG. 7 represent similar or identical elements.

Figure 3:
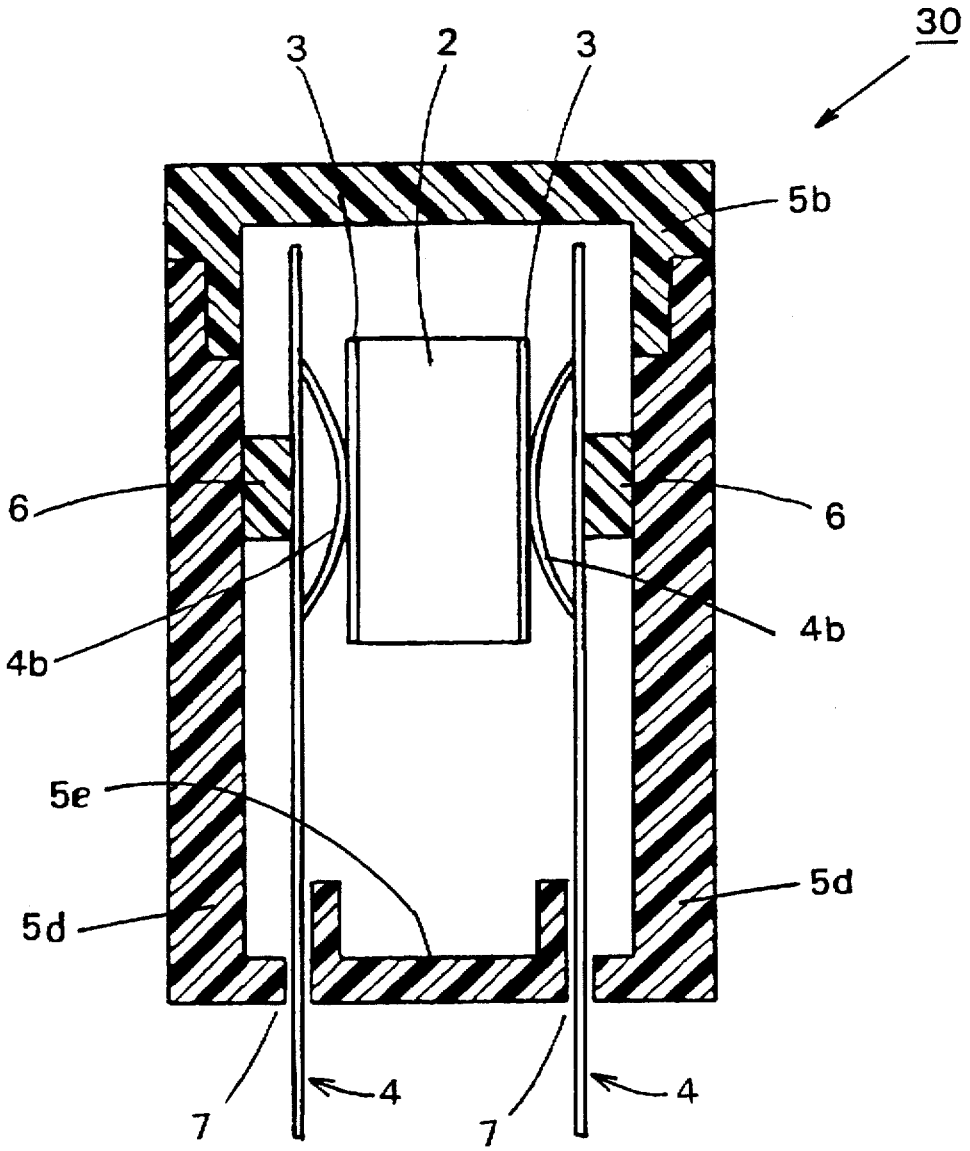
FIG. 3 is a vertical cross-sectional view of a third embodiment of the positive temperature coefficient thermistor according to the present invention.

In the positive temperature coefficient thermistor 30 shown in FIG. 3, a groove 5e slightly wider than the thickness of the semiconductor ceramic element 2 is formed on the inner side of the bottom surface of a casing body 5d. Each of the terminals 4 is held in engagement with the ceramic element 2 by a terminal holding member 6 formed of a thermoplastic resin having a low softening point.

When a large current flows in the positive temperature coefficient thermistor 30, a larger quantity of heat than that in a steady state may be generated. In that state, the temperature of each of the terminal holding members 6 increases to a value equal to and higher than the softening point of the thermoplastic resin which forms the terminal holding member 6 due to the generated heat. Accordingly, the terminal holding member 6 melts and deforms, causing the terminal 4 to fall in an outward direction due to its elasticity and thereby separate from the semiconductor ceramic element 2.

Figure 4:
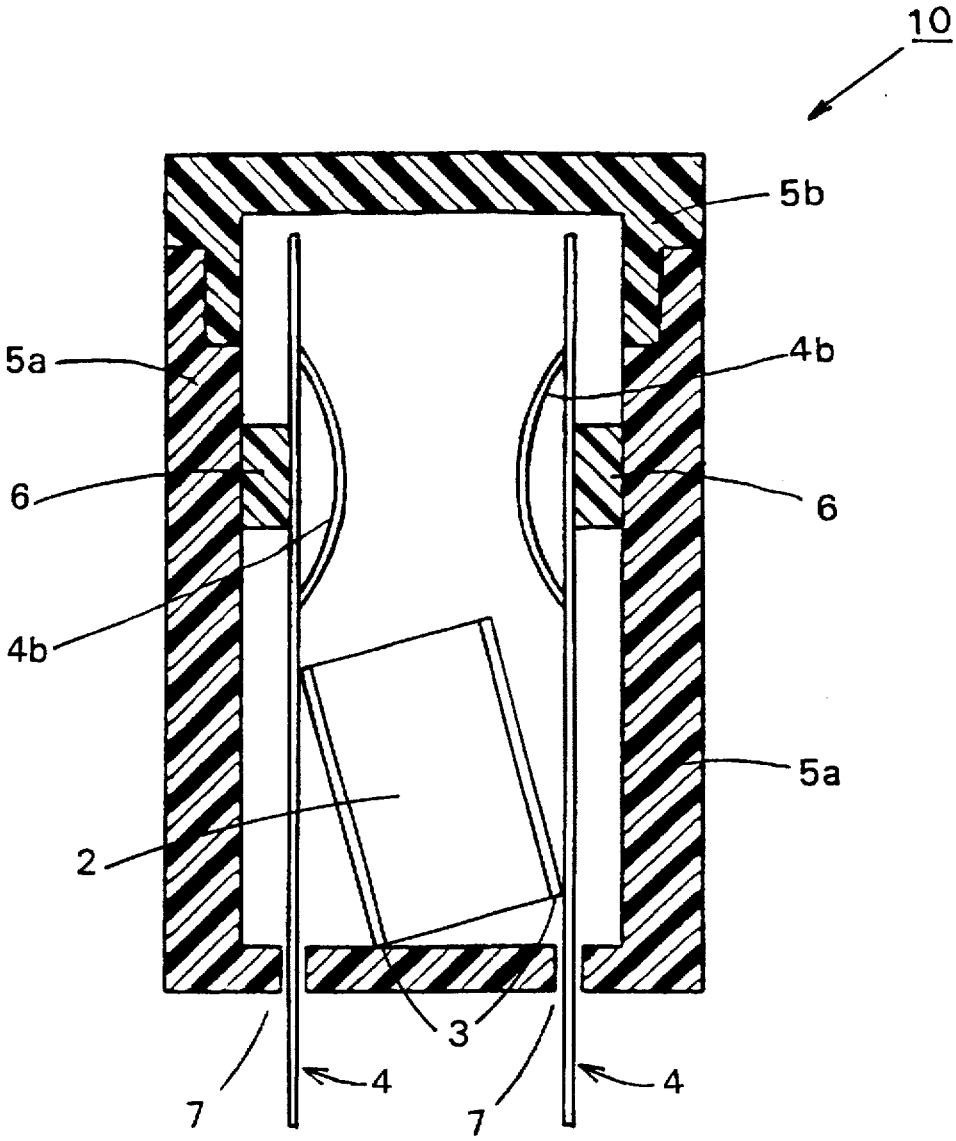
FIG. 4 is a vertical cross-sectional view of the first embodiment illustrating a state in which the positive temperature coefficient thermistor remains electrically connected after a thermal runaway.
Figure 5:
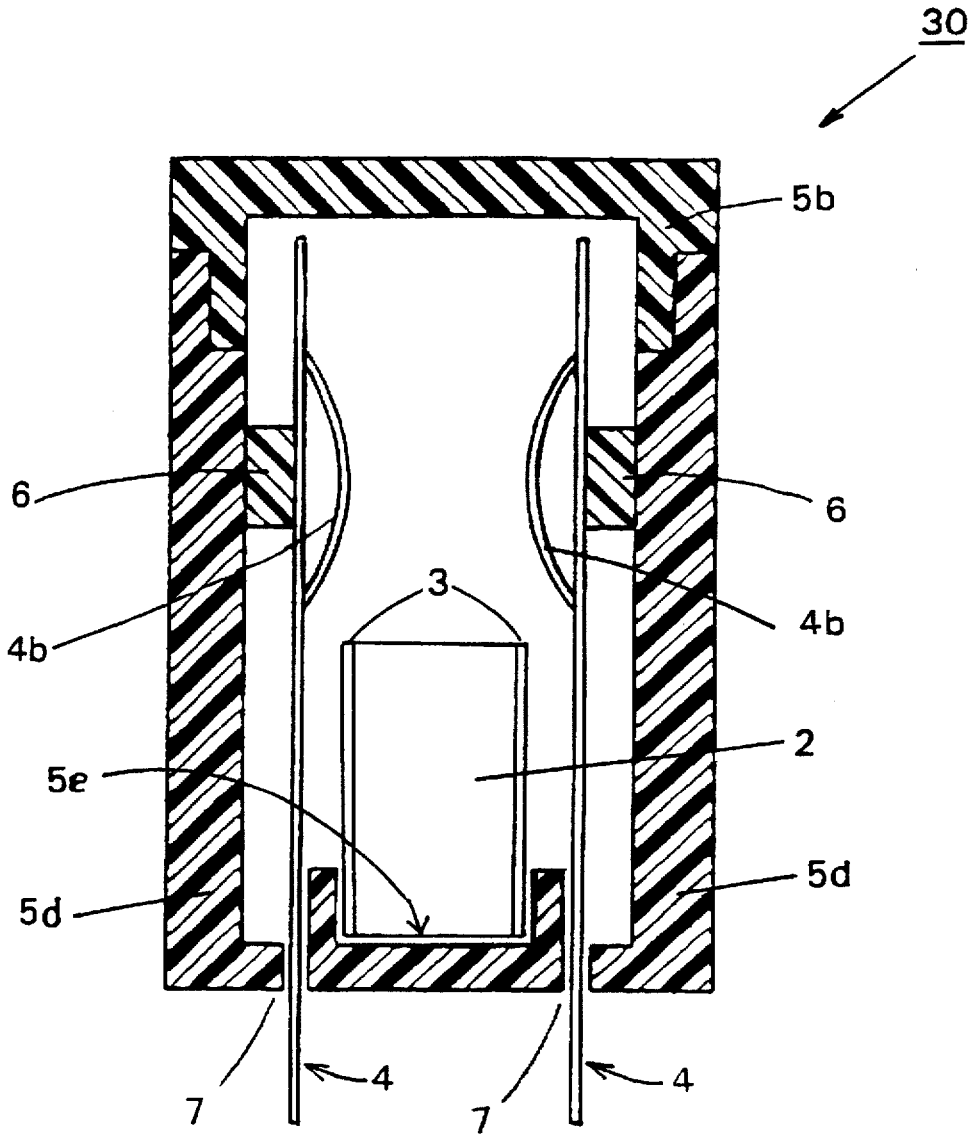
FIG. 5 is a vertical cross-sectional view of the third embodiment illustrating a state after a thermal runaway.

In the first embodiment, when the terminals 4 fall outward, the semiconductor ceramic element 2 may fall, as shown in FIG. 4, but still remain electrically connected to the terminals. The semiconductor ceramic element 2 continues to contact the terminals 4 in an inclined state even after it falls out of the spring portions 4b, and hence an electrical connection to the terminals 4 remains. To avoid this, in the third embodiment, the groove 5e is provided in the bottom portion so as to allow the current to be reliably cut off, as shown in FIG. 5. The groove 5e receives the ceramic element 2 and separates it from the terminals 4. Consequently, the circuit is heat electrically opened, and damage to the parts due to overheating can thus be prevented.

(Fourth embodiment)

A positive temperature coefficient thermistor 40 according to a fourth embodiment of the present invention will be described with reference to FIG. 6. Reference numerals in FIG. 6 identical to those in FIG. 7 represent similar or identical elements.

Figure 6:
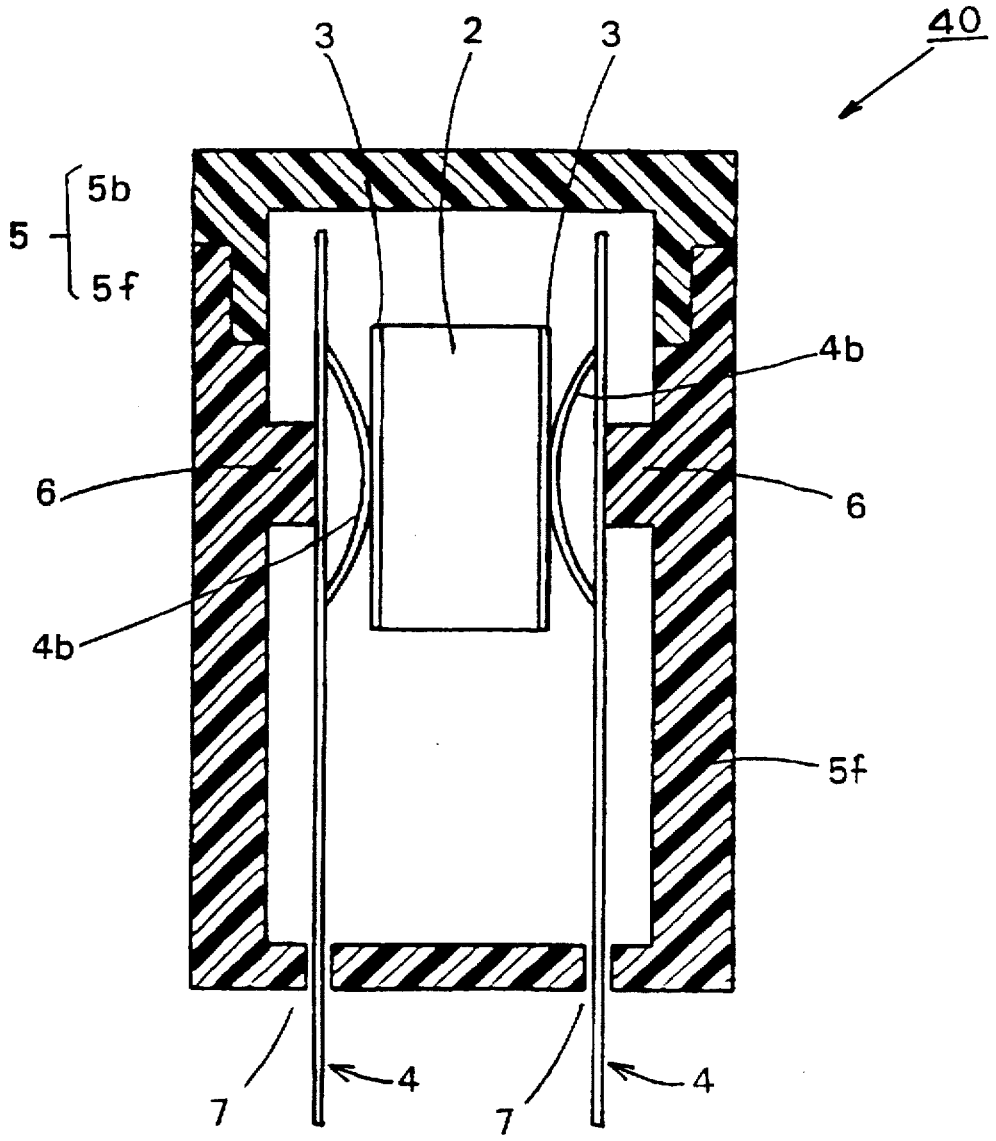
FIG. 6 is a vertical cross-sectional view of a fourth embodiment of the positive temperature coefficient thermistor according to the present invention.

In the positive temperature coefficient thermistor 40 shown in FIG. 6, both the semiconductor ceramic element 2 and the terminals 4 are accommodated in a casing body 5f formed of a thermoplastic resin having a low softening point. The spring portions 4b of the terminals 4 press against and are thereby electrically connected to the ceramic element 2. The terminals 4 are held by the terminal holding members 6 provided on the inner side of the casing body 5f. The casing body 5f and the terminal holding members 6 are formed of a thermoplastic resin having a low softening point as one unit.

When a large current flows in the positive temperature coefficient thermistor 40, a larger quantity of heat than that in a steady state may be generated. In that state, the casing body 5f and the terminal holding members 6 melt and deform, starting from the points of contact between the terminal holding members 6 and the terminals 4, due to a large amount of heat, causing the terminals 4 to be separated and thereby electrically disconnected from the semiconductor ceramic element 2 due to the elasticity of the terminal spring portions 4b. Consequently, the circuit is electrically opened, and damage to the parts due to overheating can thus be prevented.

While the foregoing has described a positive temperature coefficient thermistor as an example of the electronic part according to the present invention, the present invention can also be applied to other electronic parts for heating, current limiting, temperature sensing, and so on.

In the electronic part according to the present invention, since the portion thereof for holding the terminals is formed of a thermoplastic resin having a low softening point, when the amount of heat generated by the PTC element is increased, that portion melts and deforms, thereby electrically disconnecting the terminals from the PTC element. Consequently, the circuit is electrically opened, and damage to the parts due to overheating can thus be prevented.

Although the foregoing has described several illustrative embodiments of the invention, the invention is not limited to such embodiments, but rather should be considered to include all modifications, variations and other embodiments that may occur to those having ordinary skill in the pertinent art.

What is claimed is:

1. An electronic part, comprising:

a casing;

a PTC element within the casing; and an elastic terminal in the casing for holding said PTC element and in electrically conductive engagement with said PTC element;

said elastic terminal being urged away from said PTC element by an elastic force, and being held in contact with said PTC element by a separate terminal holding member disposed in said casing adjacent to said PTC element;

said terminal holding member being made of a material having a low softening point below a predetermined thermal runaway point of said PTC element, so that said member softens in response to heat generated by said PTC element in order to permit said terminal to be moved away from said PTC element by said elastic force and thereby release said PTC element from said terminal and break said electrically conductive engagement before thermal runaway occurs; and further comprising an enclosure in said casing comprising protrusions arranged on said casing and located at a position for receiving said PTC element after being released by said terminal and sized and shaped for separating said PTC element out of electrically conductive contact with said terminal.

2. A part as claimed in claim 1, wherein said terminal holding member is disposed between said terminal and a portion of said casing.

3. A part as claimed in claim 1, further comprising a second elastic terminal in the casing for holding said PTC element, and in electrically conductive engagement with said PTC element;

said second elastic terminal being urged away from said PTC element by an elastic force, and being held in contact with said PTC element by a second terminal holding member in said casing;

said second terminal holding member being made of a material having a low softening point below a predetermined thermal runaway point of said PTC element, so as to soften in response to heat generated by said PTC element in order to permit said terminal to be moved away from said PTC element by said elastic force, thereby releasing said PTC element from said terminals and breaking said electrically conductive engagement before thermal runaway occurs.

4. A part as claimed in claim 3, further comprising a pair of protrusions are angled on said casing at positions for blocking any movement of said terminals toward said heating element.

5. A part as claimed in claim 4, wherein said protrusions are formed integrally on said casing.

6. A part as claimed in claim 3, wherein said terminal holding members are integral said casing.

7. A part as claimed in claim 1, wherein said protrusions of said enclosure are formed integrally on said casing.

* * * * *